United States Patent [19]

Konrad et al.

[11] Patent Number: 4,907,698

[45] Date of Patent: Mar. 13, 1990

[54] ICE CREAM CARTON, CARTON BLANK, AND METHOD OF ASSEMBLY

[75] Inventors: Kenneth F. Konrad; E. David Geng, both of Kalamazoo, Mich.

[73] Assignee: James River Corporation, Richmond, Va.

[21] Appl. No.: 324,667

[22] Filed: Mar. 17, 1989

[51] Int. Cl.[4] ..... B65D 5/54

[52] U.S. Cl. ..... 206/611; 53/377; 53/491; 206/614; 206/621; 229/134; 229/905; 493/157; 493/183

[58] Field of Search ..... 229/134, 145, 905; 206/611, 614, 621; 493/128, 156, 157, 183; 53/484, 491, 377

[56] References Cited

U.S. PATENT DOCUMENTS

| | | | |
|---|---|---|---|
| 3,144,980 | 8/1964 | Larson | 229/51 |
| 3,165,254 | 1/1965 | Moore | 229/51 |
| 3,167,239 | 1/1965 | Collura | 206/614 |
| 3,197,114 | 7/1965 | Holmes | 229/51 |
| 3,206,103 | 9/1965 | Bixler | 229/51 |
| 3,206,915 | 9/1965 | Anderson et al. | 53/374 |
| 3,219,257 | 11/1965 | Anderson | 206/611 |
| 3,281,054 | 10/1966 | Buttery et al. | 229/905 |
| 3,281,055 | 10/1966 | Buttery et al. | 229/51 |
| 3,281,057 | 10/1966 | Buttery | 229/51 |
| 3,315,870 | 4/1967 | Barnes | 329/145 |
| 3,353,740 | 11/1967 | Outwater | 229/51 |
| 3,361,328 | 1/1968 | Buttery | 229/37 |
| 3,409,205 | 11/1968 | Meyers | 229/51 |
| 3,410,476 | 11/1968 | Buttery | 229/51 |
| 3,524,581 | 8/1970 | Buttery | 206/614 |
| 3,735,916 | 5/1973 | Buttery | 206/611 |
| 3,758,023 | 9/1973 | Meyers | 229/51 TC |
| 3,833,165 | 9/1974 | Hoiles | 229/37 R |
| 4,046,313 | 9/1977 | Perry | 206/611 |
| 4,113,102 | 9/1978 | Mueller | 206/611 |
| 4,150,748 | 4/1979 | Mueller | 206/624 |
| 4,239,115 | 12/1980 | Froom | 206/611 |
| 4,289,240 | 9/1981 | Mueller | 229/145 |
| 4,526,563 | 7/1985 | Froom | 493/156 |
| 4,555,027 | 11/1985 | Froom | 206/626 |
| 4,669,614 | 6/1987 | Froom | 53/491 |
| 4,712,689 | 12/1987 | Froom | 206/626 |
| 4,712,730 | 12/1987 | Froom | 229/169 |
| 4,749,086 | 6/1988 | Donohie | 206/611 |
| 4,756,470 | 7/1988 | DePaul | 229/134 |
| 4,757,902 | 7/1988 | Hutchinson et al. | 206/626 |
| 4,838,432 | 6/1989 | DePaul | 206/611 |

*Primary Examiner*—Gary Elkins

*Attorney, Agent, or Firm*—Finnegan, Henderson, Farabow, Garrett & Dunner

[57] ABSTRACT

A carton blank and a method for folding and gluing it into a reclosable carton. Corner post flaps are releasably adhered to front end flaps to permit release of the corner post flaps from the front end flaps when the top of the top opening container is initially raised to provide access to the contents.

6 Claims, 4 Drawing Sheets

ICE CREAM CARTON, CARTON BLANK, AND METHOD OF ASSEMBLY

BACKGROUND OF THE INVENTION

1. Field of the Invention

This invention relates to packaging and is particularly directed to a package or carton for ice cream and the like, a carton blank, and a method of folding and gluing the carton blank into a reclosable top-opening ice cream carton.

2. Description of the Related Art

Ice cream and similar products are packaged by dairies for ultimate sale to consumers. The bulk of the cartons currently in use for packaging ice cream are of a type known as the lock end box. According to one estimate, such lock end or interlocking end cartons account for as much as 60% of the market.

In recent years, there has been an increased need for tamper-evident and tamper-resistant packaging. Although a number of tamper-resistant cartons have been developed over the past few years, these conventional tamper-resistant cartons typically require expensive machinery to erect, fill, fold, and seal the tamper-resistant cartons. That is, dairies using existing machinery for the interlocking end cartons cannot use that existing machinery for conventional tamper-resistant cartons; and the high cost of replacing existing machinery has generally inhibited wide-spread use of conventional tamper-resistant cartons.

The carton of the present invention, on the other hand, is not only tamper-evident and tamper-resistant, it also can be used on existing machinery (such as an Anderson 555 ice cream filling and closing machine) with relatively inexpensive modifications.

In addition, the present invention provides a reclosable cover having a very tight fit as compared to cartons formed and closed on a form/fill machine, as is the case with cartons of the Tuck-Tite and the Zip Serve constructions.

SUMMARY OF THE INVENTION

In summary, then, the present invention provides a distinct advantage to the consumer in the form of a tamper-evident and tamper-resistant carton having a tight fitting, reclosable cover; and an advantage to the supplier in the form of a simple flap folding and gluing sequence resulting in a more efficient operation in a dairy or other filling location.

The present invention provides a tamper-evident top-opening carton comprising (A) a receptacle portion having opposite ends and including front, bottom, rear, front, and top panels hingedly connected to each in the order stated.

(B) means for closing one end of the carton including a bottom end flap hingedly connected to the bottom panel;

a rear end flap hingedly connected to the rear panel and adhesively connected to the bottom end flap;

a front end flap hingedly connected to the front panel and adhesively connected to the bottom end flap;

a front cover sealing flap, having (1) a front cover skirt hingedly connected to the top panel, (2) a first adhesive tab adhesively connected to the front panel, (3) a tear strip connecting the front cover skirt to the first adhesive tab, and (4) a corner post flap having (a) a corner hood tab hingedly connected to the front cover skirt, (b) a second adhesive tab adhesively connected to the front end flap, and (c) a first severance line connecting the corner hood tab to the second adhesive tab for severing the corner hood tab from the second adhesive tab when a user initially opens the carton;

a top end flap, hingedly connected to the top panel, having an end cover skirt adhesively connected to the corner hood tab, a third adhesive tab adhesively connected to the rear end flap, and a second severance line connecting the end cover skirt to the third adhesive tab for severing the end cover skirt from the third adhesive tab;

wherein the top panel, the end cover skirt, the front cover skirt, and the corner hood tab form a reclosable cover for the carton, when a user removes the tear strip and severs the end cover skirt from the third adhesive tab and severs the corner hood tab from the second adhesive tab; and (C) means for closing the other end of the carton.

The present invention is also directed to a method of closing an end of a carton tube erected from a carton blank, comprising the steps of folding in the bottom end flap and folding out the top end flap; applying strips of adhesive to the bottom end flap and the top end flap; folding in the front end flap into contact with the bottom end flap adhesive strips for adhering the front end flap to the bottom end flap, the corner post flap also being folded to form part of the end of the receptacle because of the adhesive attachment of the second adhesvie tab to the front panel end flap; folding in the rear end flap into contact with the bottom end flap adhesive strips for adhering the rear end flap to the bottom end flap; and folding in the top end flap for adhering the top end flap to the corner post flap and to the rear end flap; and closing the other end of the receptacle.

BRIEF DESCRIPTION OF THE DRAWINGS

The accompanying drawings which are incorporated in and constitute a part of this specification, illustrate preferred embodiments of the invention and, together with the description serve, to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
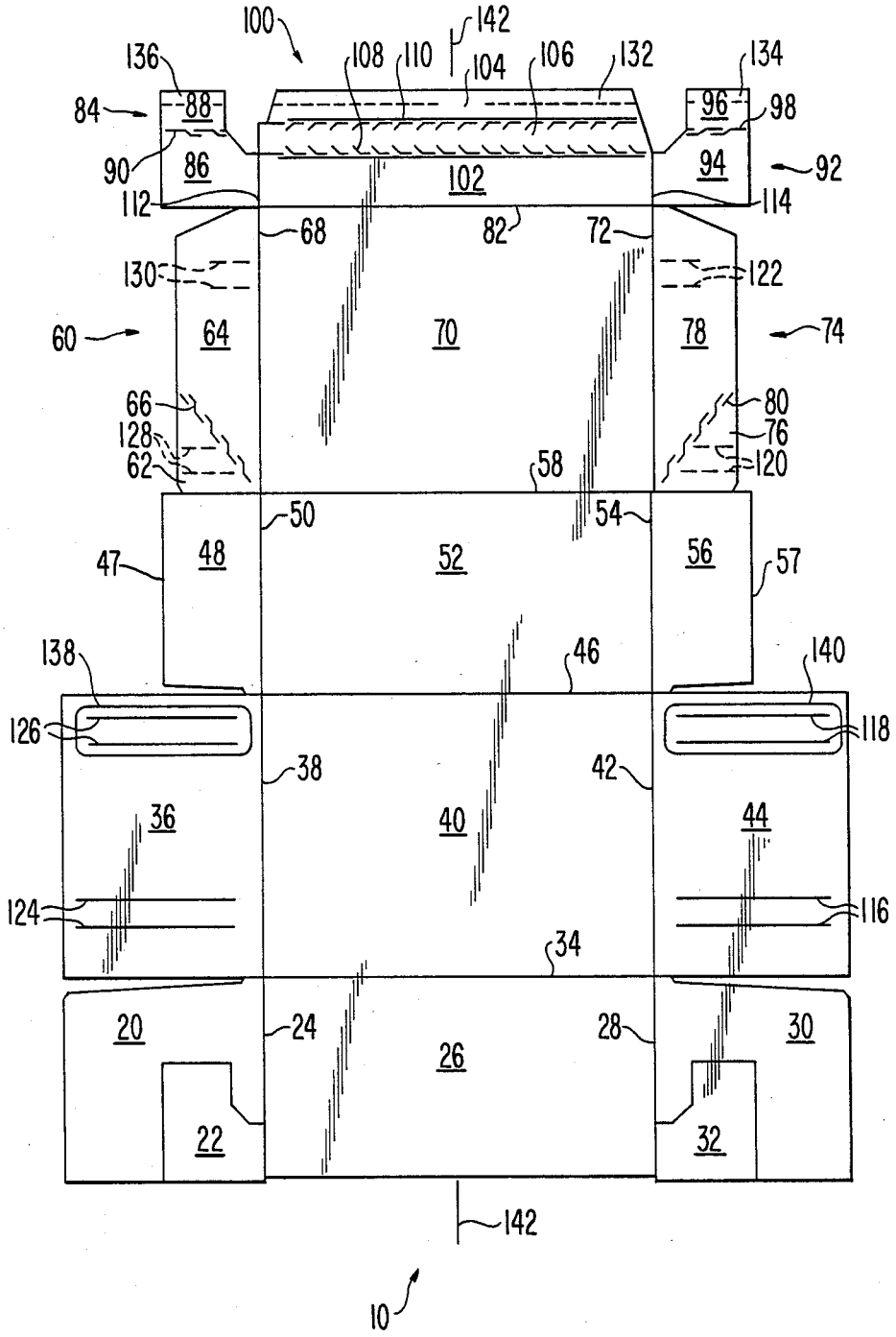
FIG. 1 is a plan view of a carton blank of the present invention.

A preferred embodiment of the carton blank of the present invention is shown in FIG. 1. Carton blank 10 includes front panel 26, bottom panel 40, rear panel 52, and top cover panel 70. These panels are hingedly connected to each other in the order stated by score lines 34, 46, and 58, respectively. Hingedly connected to front panel 26 along score line 24 is left front end flap 20 having an indented debossed portion 22. Hingedly connected to front panel 26 along score line 28 is right front end flap 30 having an indented debossed portion 32.

Indented portions 22 and 32 are adapted to receive corner post flaps 84 and 92. Indented portions 22 and 32 provide for a better adhesive bond when carton blank 10 is glued by a carton forming/filling machine. Indented portions 22 and 32 also result in a smoother outside end surface so that finished cartons will not catch on one another as they are rubbed in a side-by-side manner, for example, during distribution or merchandising in a retail outlet.

Hingedly connected to bottom panel 40 along score line 38 is left bottom end flap 36. Hingedly connected to bottom panel 40 along score line 42 is right bottom end flap 44.

In one preferred embodiment, left bottom end flap 36 includes embossed or raised portion 138, and right bottom end flap 44 includes embossed or raised portion 140. Raised portions 138, 140 preferably do not extend beyond edges 47 and 57, respectively, when rear end flaps 48 and 56 are folded into position. Raised portions 138, 140 are adapted to receive adhesvie strips 126, 118 and to urge them into adhesive contact with rear end flaps 48, 56 for bonding flaps 48, 56 to bottom end flaps 36, 44, respectively.

Hingedly connected to rear panel 52 along score line 50 is left rear end flap 48. Hingedly connected to rear panel 52 along score line 54 is right rear end flap 56.

Hingedly connected to top cover panel 70 along score line 68 is left top end flap 60 which includes adhesive tab 62 and left end cover skirt 64 separated from each other by severance line 66. Hingedly connected to top cover panel 70 along score line 72 is right top end flap 74 which includes adhesive tab 76 and right end cover skirt 78 separated from each other by severance line 80.

Hingedly connected to top cover panel 70 along score line 82 is front cover sealing flap 100, which includes front cover skirt 102 and adhesive tab 104 separated from each other by tear strip 106 which is defined by severance lines 108 and 110. Hingedly connected to front cover skirt 102 of front cover sealing flap 100 along score line 112 is left corner post flap 84 which includes corner hood tab 86 and adhesive tab 88 separated from each other by severance line 90. Hingedly connected to front cover skirt 102 of front cover sealing flap 100 along score line 114 is right corner post flap 92 which includes corner hood tab 94 and adhesive tab 96 separated from each other by severance line 98.

Corner post flaps 84, 94 are so configured that corner hood tabs 86, 94 will break away from adhesive tabs 88, 96 along severance lines 90, 98 when a consumer initially opens cover 16 and yet maintain the integrity and functionality of cover 16.

Figure 2:
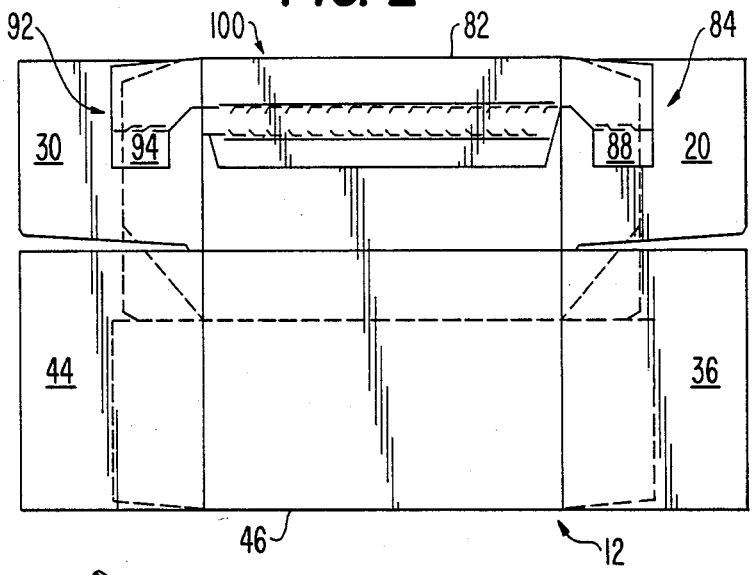
FIG. 2 is a plan view of a collapsed carton tube formed from the carton blank of FIG. 1 with the front cover sealing flap and the corner post flap glued to the front panel and the front end flap, respectively.

According to the present invention, carton blank 10 is folded along score lines 46 and 82 as shown in FIG. 2 to form a collapsed carton tube 12 wherein front cover sealing flap 100 is sealed to front panel 26 by adhesive strip 132, and wherein corner post flaps 84, 92 overlie indented portions 22, 32 and adhesive tabs 88, 96 are adhesively connected to front end flaps 20, 30 by adhesive strips 136, 134. Preferably, adhesive strips 132, 134, and 136 are applied to adhesive tabs 104, 96, and 88, respectively. Alternatively, adhesive strips 132, 134, and 136 could be applied to front panel 26 and indented portions 32, 22, respectively.

This stage of the folding and gluing sequence can be accomplished during the manufacturing and conversion process. Indeed, because corner post flap 84 is glued down during manufacture, reclosable cover 16 has a very tight fit compared to covers having corner posts formed and closed on the ice cream filling and closing machine.

Figure 3:
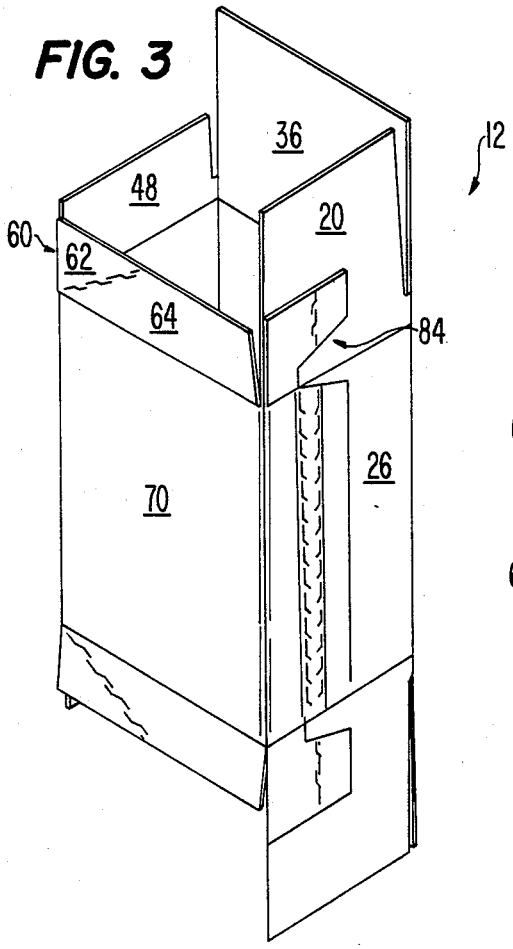
FIG. 3 is a perspective view of the carton tube of FIG. 2 which has been erected or squared up.

As shown in FIG. 3, carton tube 12 has been squared for closure of one end and for receiving ice cream or other product such as a fluid semi-solid mass to be packaged.

Figure 4:
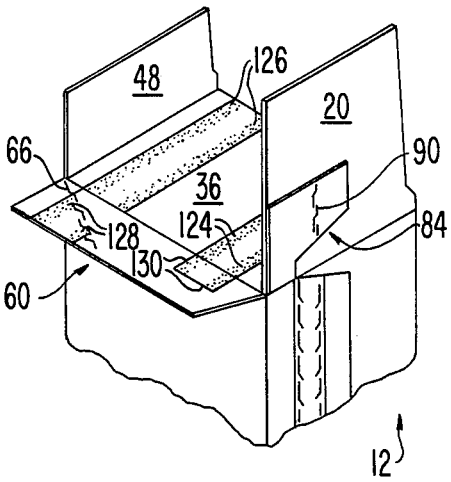
FIG. 4 is a fragmentary perspective view of the carton tube of FIG. 3 showing the bottom end flap folded in, the top end flap folded out, and adhesive strips applied.

The present invention also provides a simple and efficient sequence for folding and gluing a carton blank into a reclosable carton. According to the invention, after squaring or erecting carton tube 12, bottom end flap 36 is folded in to close the major end opening of the carton. Top end flap 60 is folded out, that is, away from bottom end flap 36 as illustrated in FIG. 4. Adhesive strips 124 and 126 are preferably parallel to each other and are applied to bottom end flap 36. Adhesive strips 128 are applied to adhesive tab 62 and adhesive strips 130 are applied to end cover skirt 64. Note that adhesive strips 124 are preferably colinear with adhesive strips 130, and that adhesive strips 126 are preferably colinear with adhesive strips 128. It is preferred that adhesive strips 128 not extend beyond severance line 66 and, similarly, that adhesive strips 130 not extend beyond severance line 90 after corner post flap 84 is folded into position, as will be discussed more fully below. Although parallel adhesive strips are preferred, other configurations and types of glue or adhesive may also be used.

Figure 5:
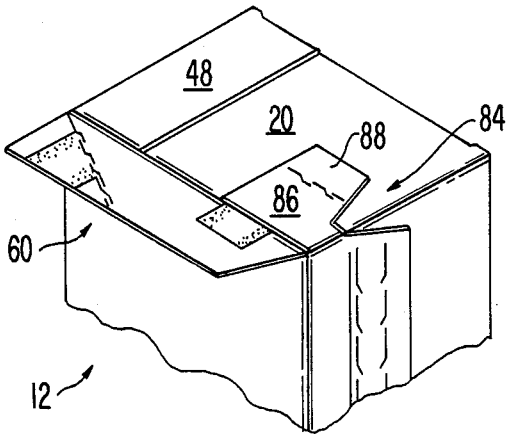
FIG. 5 is a perspective view of the carton tube of FIG. 4 showing the front end flap folded in and the rear end flap folded in and overlying the front end flap.

As shown in FIG. 5, front end flap 20 is folded in into contact with adhesive strips 124 for adhesively connecting front end flap 20 to bottom end flap 36. Because corner post flap 84 was previously glued to front end flap 20 during, e.g., manufacture, corner post flap 84 is folded into position along with front end flap 20.

Next, rear end flap 48 is folded in into contact with adhesive strips 126 for adhesively connecting rear end flap 48 to bottom end flap 36. It is preferred that rear end flap 48 slightly overlie front end flap 20. In such a configuration, it is preferred that rear end flap 48 be shorter, and thus stiffer, than front end flap 20 for holding front end flap 20 in and thus preventing it from "gull-winging" during the freeze/thaw cycles of distribution and retailing.

Alternatively, front end flap 20 could overlie rear end flap 48 with corresponding changes in relative size and folding sequence, for example, folding in rear end flap 48 prior to folding in front end flap 29. Also alternatively, flaps 20 and 48 can be configured to eliminate overlap.

Figure 6:
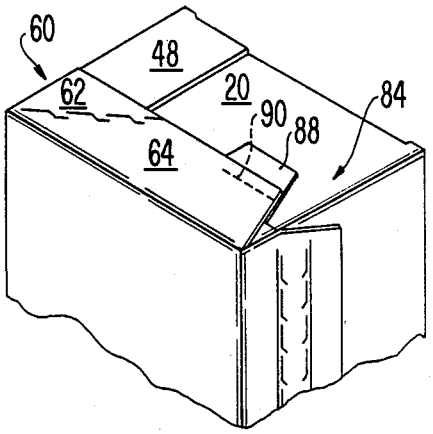
FIG. 6 is a perspective view of the carton tube of FIG. 5 showing the top end flap folded in, forming a carton of the present invention.

Next, top end flap 60 is folded in for adhesively connecting top end flap 60 to corner post flap 84 and rear end flap 48, thus closing and sealing one end of the carton as illustrated in FIG. 6. In this embodiment, end cover skirt 64 substantially covers or hides severance line 90, shown in shadow in FIG. 6, and partially overlies adhesive tab 88. This configuration, in addition to its functional advantages, offers a more pleasant appearing carton. Alternatively, the relative size and shape of top end flap 60 and corner post flap 84 can be configured so that end cover skirt 64 substantially entirely covers adhesive tab 88, or, alternatively, so that severance line 90 and adhesive tab 88 are partially, or substantially entirely, uncovered.

It is preferred that carton blank 10 be substantially symmetrical about its longitudinal axis 142 as shown in FIG. 1. Accordingly, after filling, the other end of carton tube 12 may be closed in substantially identical fashion. It is preferred that the means for closing the other end includes front end flap 30, bottom end flap 44, rear end flap 56, top end flap 74, corner post flap 92, and adhesive strips 116–122.

Figure 8:
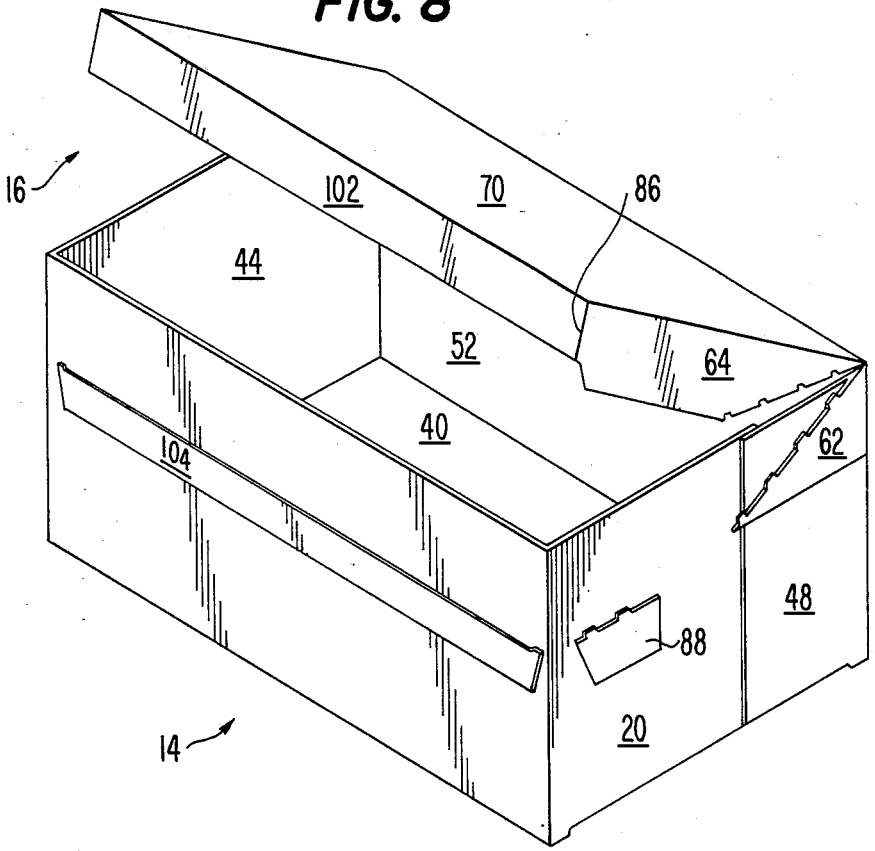
FIG. 8 is a perspective view of the carton of FIG. 7 showing the reclosable cover in an open position.
Figure 7:
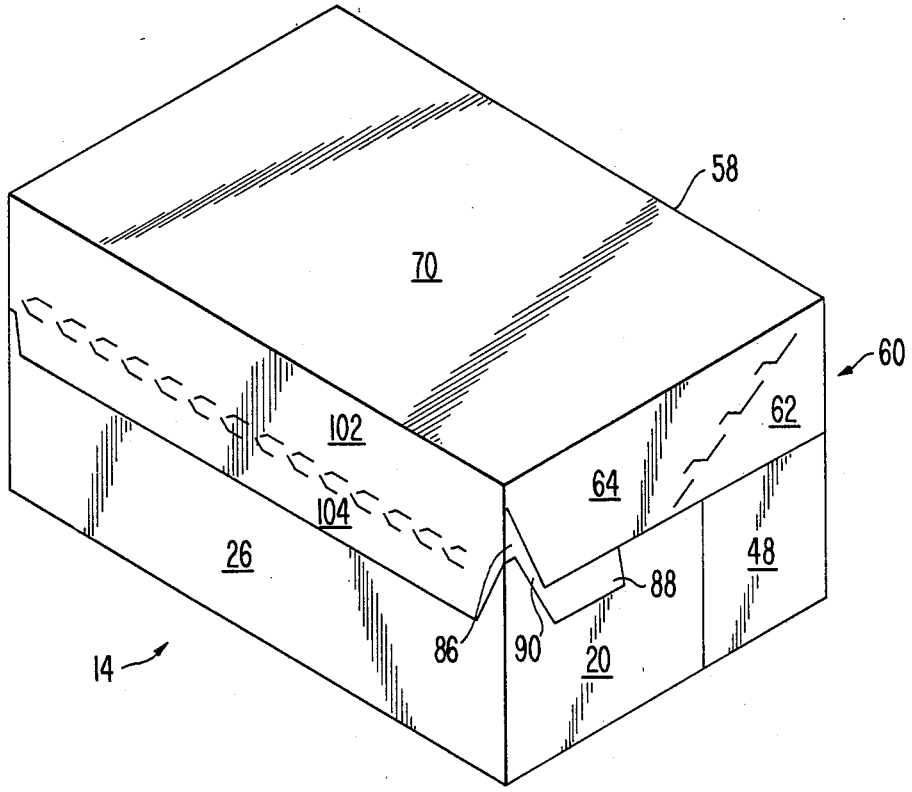
FIG. 7 is a perspective view of closed carton of the present invention.

Carton 14 is initially opened when a consumer or other user removes tear strip 106 and severs severance lines 66 and 90. Top panel 70, end cover skirt 64, front cover skirt 102 and corner hood tab 86 thus form reclosable cover 16 which may be pivoted about score line 58 from its initial closed position shown in FIG. 7 to an open position shown in FIG. 8.

It will be apparent to those skilled in the art that various modifications and variations may be made to the product and the method of the invention without departing from the scope or the spirit of the invention.

We claim:

1. A tamper-evident, top-opening carton comprising:

(A) a receptacle portion having opposite ends and including front, bottom, rear, and top panels hingedly connected to each other in the order stated;

(B) means for closing one end of said carton including a bottom end flap hingedly connected to the bottom panel;

a rear end flap hingedly connected to the rear panel and adhesively connected to the bottom end flap;

a front end flap hingedly connected to the front panel and adhesively connected to the bottom end flap;

a front cover sealing flap, having (1) a front cover skirt hingedly connected to the top panel, (2) a first adhesive tab adhesively connected to the front panel, (3) a tear strip connecting the front cover skirt to the first adhesive tab, and (4) a corner post flap having (a) a corner hood tab hingedly connected to the front cover skirt, (b) a second adhesive tab adhesively connected to the front end flap, and (c) a first severance line connecting the corner hood tab to the second adhesive tab for severing the corner hood tab from the second adhesive tab when a user initially opens the carton;

a top end flap, hingedly connected to the top panel, having an end cover skirt adhesively connected to the corner hood tab, a third adhesive tab adhesively connected to the rear end flap, and a second severance line connecting the end cover skirt to the third adhesive tab for severing the end cover skirt from the third adhesive tab when a user initially opens the carton;

wherein the top panel, the end cover skirt, the front cover skirt, and the corner hood tab form a reclosable cover for the carton, when a user removes the tear strip and severs the end cover skirt from the third adhesive tab and severs the corner hood tab from the second adhesive tab; and (C) means for closing the other end of the carton.

2. The carton of claim 1 wherein the means for closing the other end of the carton is substantially identical to the means for closing the one end of the carton.

3. An integral carton blank for forming a reclosable top-opening carton comprising:

(A) front, bottom, rear, and top panels, hingedly connected to each other in the order stated, for forming a receptacle portion having opposite ends;

(B) means for closing one end of said receptacle portion including a bottom end flap hingedly connected to the bottom panel;

a rear end flap hingedly connected to the rear panel and adapted to be adhesively connected to the bottom end flap;

a front end flap hingedly connected to the front panel and adapted to be adhesively connected to the bottom end flap;

a first cover sealing flap, having (1) a front cover skirt hingedly connected to the top panel, (2) a first adhesive tab adapted to be adhesively connected to the front panel, (3) a tear strip connecting the front cover skirt to the first adhesive tab, (4) a corner post flap having (a) a corner hood tab hingedly connected to the front cover skirt, (b) a second adhesive tab adapted to be adhesively connected to the front end flap, and (c) a first severance line connecting the corner hood tab to the second adhesive tab for severing the corner hood tab from the second adhesive tab;

a top end flap, hingedly connected to the top panel, having an end cover skirt adapted to be adhesively connected to the corner hood tab, a third adhesive tab adapted to be adhesively connected to the rear end flap, and a second severance line connecting the end cover skirt to the third adhesvie tab for severing the end cover skirt from the third adhesive tab;

wherein the top panel, the end cover skirt, the front cover skirt, and the corner hood tab are adapted to form a reclosable cover for the carton; and (C) means for closing the other end of the receptacle portion.

4. A method of closing an end of a carton tube erected from a carton blank having (A) a receptacle portion having opposite ends and including front, bottom, rear, and top panels hingedly connected to each other in the order stated;

(B) means for closing one end of said receptacle including a bottom end flap hingedly connected to the bottom panel;

a rear end flap hingedly connected to the rear panel and adapted to be adhesively connected to the bottom end flap;

a front end flap hingedly connected to the front panel and adapted to be adhesively connected to the bottom end flap;

a front cover sealing flap, having (1) a front cover skirt hingedly connected to the top panel, (2) a first adhesive tab adhesively connected to the front panel, (3) a tear strip connecting the front cover skirt to the first adhesive tab, and (4) a corner post flap having (a) a corner hood tab hingedly connected to the front cover skirt, (b) a second adhesive tab adhesively connected to the front end flap, (c) a first severance line connecting the corner hood tab to the second adhesive tab for severing the corner hood tab from the second adhesive tab when a user initially opens the carton; and a top end flap, hingedly connected to the top panel, having an end cover skirt adapted to be adhesively connected to the corner hood tab, a third adhesive tab adapted to be adhesively connected to the rear end flap, and a second severance line connecting the end cover skirt to the third adhesive tab for severing the end cover skirt from the third adhesive tab when a user initially open the carton;

wherein the top panel, the end cover skirt, the front cover skirt, and the corner hood tab are adapted to form a reclosable cover for the carton;

said method comprising the steps of:

folding in the bottom end flap and folding out the top end flap;

applying adhesive to the bottom end flap and the top end flap;

folding in the front end flap into contact with the bottom end flap adhesive for adhering the front end flap to the bottom end flap, the corner post flap also being folded to form part of the end of the receptacle because of the adhesive attachment of the second adhesive tab to the front end flap;

folding in the rear end flap into contact with the bottom end flap adhesive for adhering the rear end flap to the bottom end flap; and folding in the top end flap for adhering the top end flap to the corner post flap and to the rear end flap.

5. The method of claim 4, wherein the carton blank further includes means for closing the other end of the receptacle, further comprising the step of closing the other end of the receptacle.

6. The method of claim 4, wherein the carton blank further includes means for closing the other end of the receptacle, and further comprising the steps of filling the carton tube with desired product; and closing the other end of the carton tube.

* * * * *